US005421225A

United States Patent [19]

Chen

[11] Patent Number: 5,421,225

[45] Date of Patent: Jun. 6, 1995

[54] FOLDABLE WRENCH CAPABLE OF CONTAINING VARIOUS TOOL BITS THEREIN

[76] Inventor: Chung-ming Chen, 11F, No.67, Sec. 1, Ho-ping East Road, Taipei, Taiwan, Prov. of China

[21] Appl. No.: 260,721

[22] Filed: Jun. 15, 1994

[51] Int. Cl.[6] ..... B25G 1/08

[52] U.S. Cl. ..... 81/490; 81/177.4

[58] Field of Search ..... 81/490, 437–439, 81/177.8, 177.1, 177.2, 177.4, 177.6, 177.7

[56] References Cited

U.S. PATENT DOCUMENTS

| | | | |
|---|---|---|---|
| 4,302,990 | 12/1981 | Chrichton et al. | 81/177.4 X |
| 4,627,315 | 12/1986 | Lin | 81/177.4 |
| 4,926,721 | 5/1990 | Hsino | 81/177.4 |
| 4,934,223 | 6/1990 | Wong | 81/177.4 X |
| 5,174,178 | 12/1992 | Disston, Jr. | 81/177.4 X |

*Primary Examiner*—D. S. Meislin
*Attorney, Agent, or Firm*—Bacon & Thomas

[57] ABSTRACT

Disclosed is a foldable wrench capable of containing various tool bits. The wrench consists of a fixed handle having a first compartment for accommodating rod-shaped tool bits, a first removable cover for covering the first compartment, a movable handle having a second compartment for accommodating socket-shaped tool bits, a second removable cover for covering the second compartment, and a riveting pin pivotally connecting the first removable cover, the fixed handle, the movable handle, and the second removable cover, through holes formed on overlapping portions separately provided on the four components so that each of such components can be pivotally turned about the riveting pin relative to one another. By this way, tool bits contained in the first and the second compartments can be easily retrieved or stored by conveniently turning the first and the second removable covers away from the fixed and the movable handles, respectively; and, the fixed and the movable handles may be turned toward each other from a perpendicular relation to a parallel relation to occupy the smallest possible room for convenient carrying and storage.

1 Claim, 5 Drawing Sheets

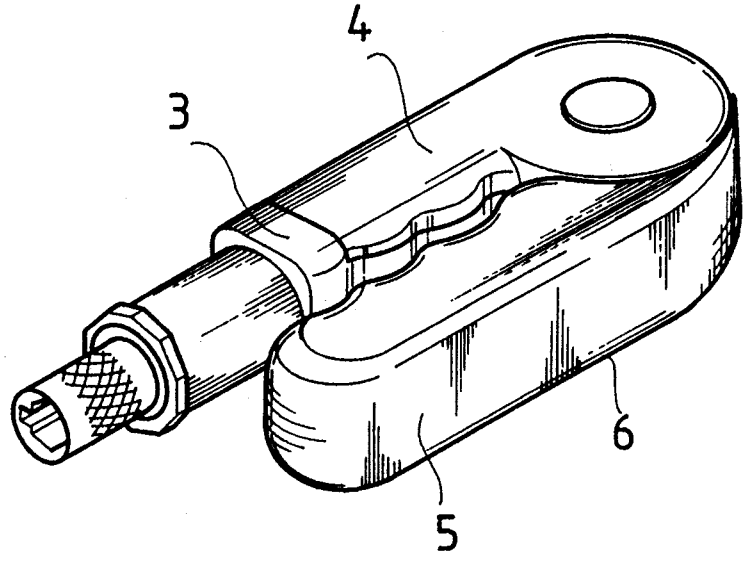
FIG,4
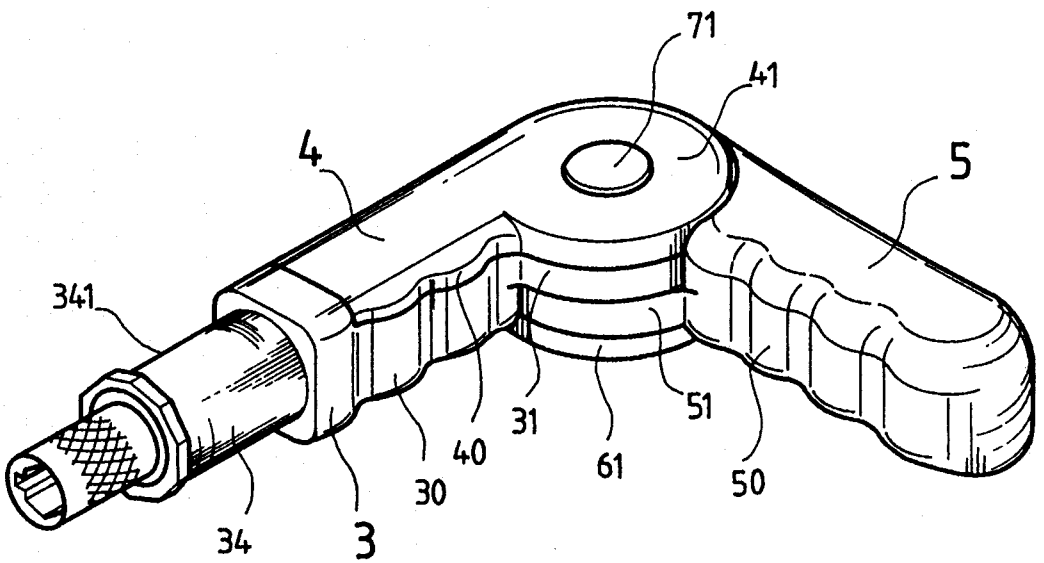
FIG,3

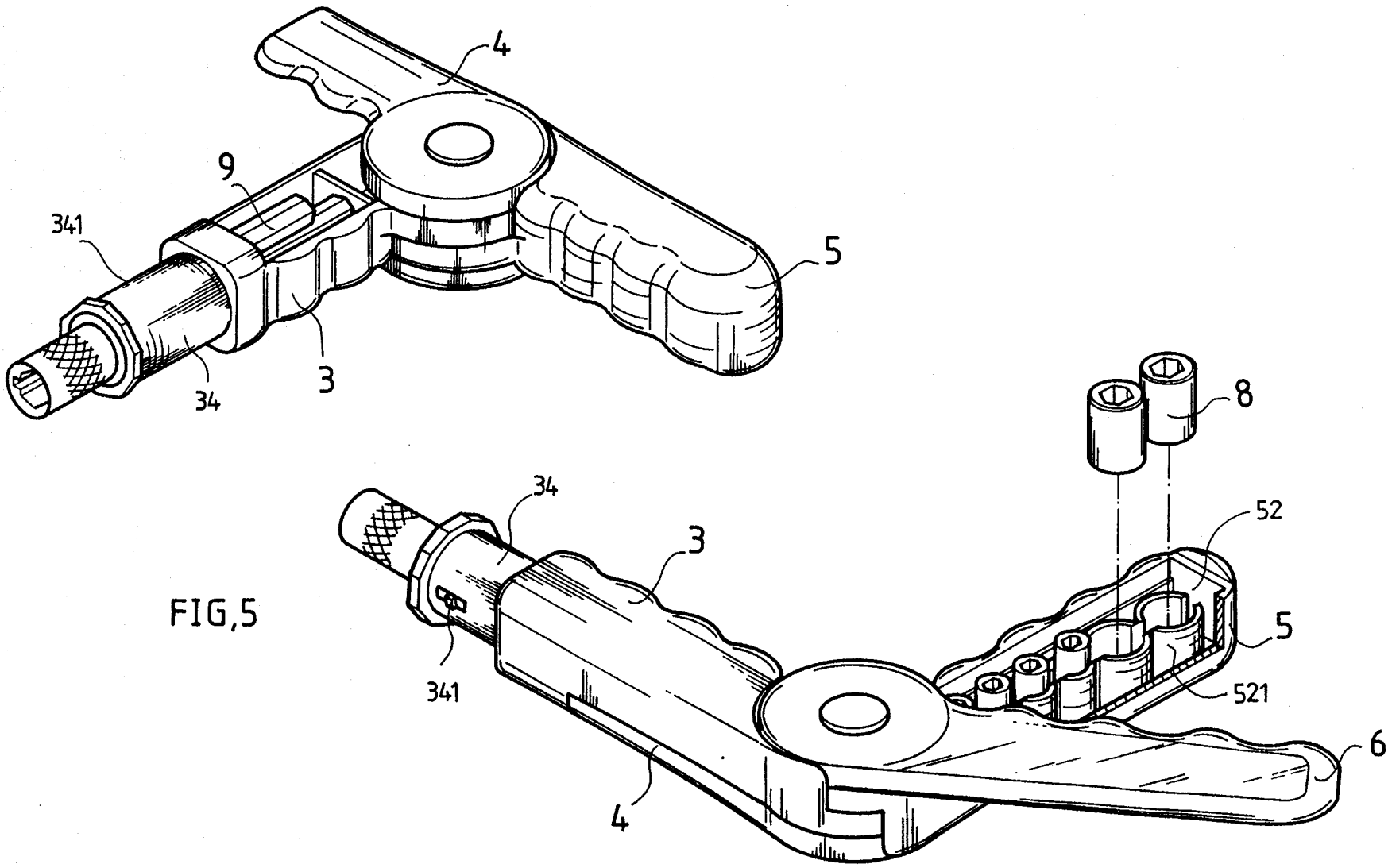
FIG,5

FOLDABLE WRENCH CAPABLE OF CONTAINING VARIOUS TOOL BITS THEREIN

BACKGROUND OF THE INVENTION

The present invention relates to a wrench which can be used to store various tool bits in compartments formed thereon, and more particularly to a foldable wrench which consists of a set of pivotally connected fixed handle and movable handle both of which have an inner compartment and a removable cover to accommodate various tool bits in the compartments of the two handles while the two handles can be turned toward each other to a folded state to occupy the smallest possible room for easy carrying.

Please refer to FIG. 1 in which a conventional T-shaped wrench is shown. The T-shaped wrench includes a T-shaped body 1, a receiving head 12 in front of the T-shaped body 1 for fitly receiving a tool bit 2 therein, a control switch 13 provided between the T-shaped body 1 and the front receiving head 12 for controlling the positive turning, reverse turning, and fixation of the receiving head 12. To carry multiple tool bits 2, the T-shaped body 1 of the wrench is formed with a plurality of through holes 11 for accommodating additional tool bits 2. Since the tool bits 2 are inserted into the through holes 11 when they are not in use, with only one bit 2 that is to be used inserting into the receiving head 12. That is, there is always one bit 2 inserted in the receiving head 12. As a result, the wrench tends to dangerously stab or scrape a user carrying or handling it. In addition, when the T-shaped wrench is used under applied force or is placed down, the additional tool bits 2 inserted in the through holes 11 are apt to fall or slip out of the T-shaped body 1 due to continuous sway or vibration during operation. The tool bits 2 are therefore subject to careless missing or damage which causes great inconvenience especially when they are required in the operation. Furthermore, the T-shaped wrench is integrally formed which occupies considerably big volume which not only makes the wrench inconvenient in carrying but also makes the user to handle the T-shaped body 1, turn the tool bit 2 in the receiving head 12 in a labor and time consuming manner. Moreover, such conventional wrench is limited to work with rod-shaped tool bits and can not match with socket-shaped tool bits. Since there are limited through holes 11 formed on the T-shaped body 1, other supplementary tool bits 2 can not be stored on the body 1. It is therefore tried by the inventor to develop a wrench which may effectively contain various tool bits for safely and conveniently carrying them with the wrench for different operations.

SUMMARY OF THE INVENTION

A primary object of the present invention is to provide a wrench capable of containing various tool bits therein in a completely stable manner while the stored tool bits can be conveniently and quickly accessed for use.

A further object of the present invention is to provide a foldable wrench capable of containing various tool bits therein which has a simple structure for easy assembling and occupies small room for convenient carrying.

The foldable wrench according to the present invention mainly includes a fixed handle having a first removable cover, and a movable handle having a second removable cover.

Both of the fixed and the movable handles have a compartment formed under the removable cover for separately, orderly and securely storing rod-shaped and socket-shaped tool bits. The fixed and the movable handles and the first and the second covers have a holed overlapping portion for them to pivotally connect with one another by means of a riveting pin passing through the hole formed in their overlapping portion. Various tool bits can be conveniently stored in or retrieved from the handle compartments of the wrench while the handles can be folded toward each other to occupy the smallest possible room for convenient carrying.

BRIEF DESCRIPTION OF THE DRAWINGS

The technique adopted to achieve the characteristics and functions of the present invention can be best understood by referring to the following detailed description of the preferred embodiment and the accompanying drawings, wherein

FIG. 3 is an assembled perspective of the embodiment shown in FIG. 2 in an extended state;

FIG. 4 is an assembled perspective of the embodiment shown in FIG. 2 in a folded state;

FIG. 5 illustrates the manner in which the removable covers of the present invention are pivotally turned to open the compartments accommodating the tool bits.

DETAILED DESCRIPTION OF THE PREFERRED EMBODIMENT

Figure 1:
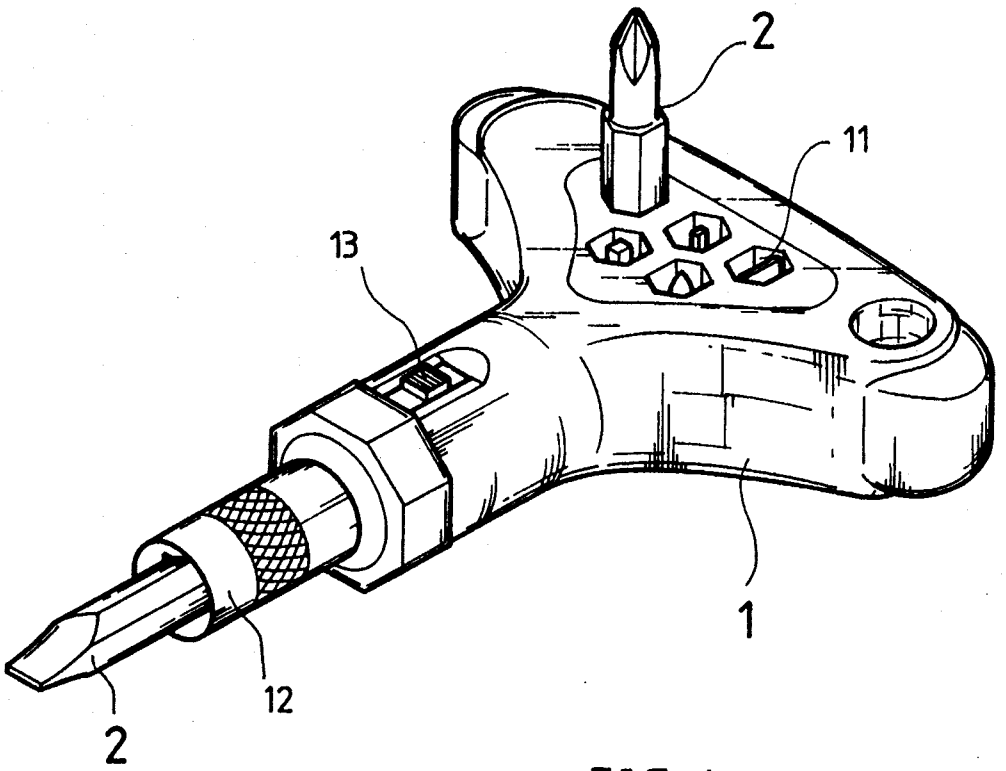
FIG. 1 is a perspective view showing a conventional wrench.
Figure 2:
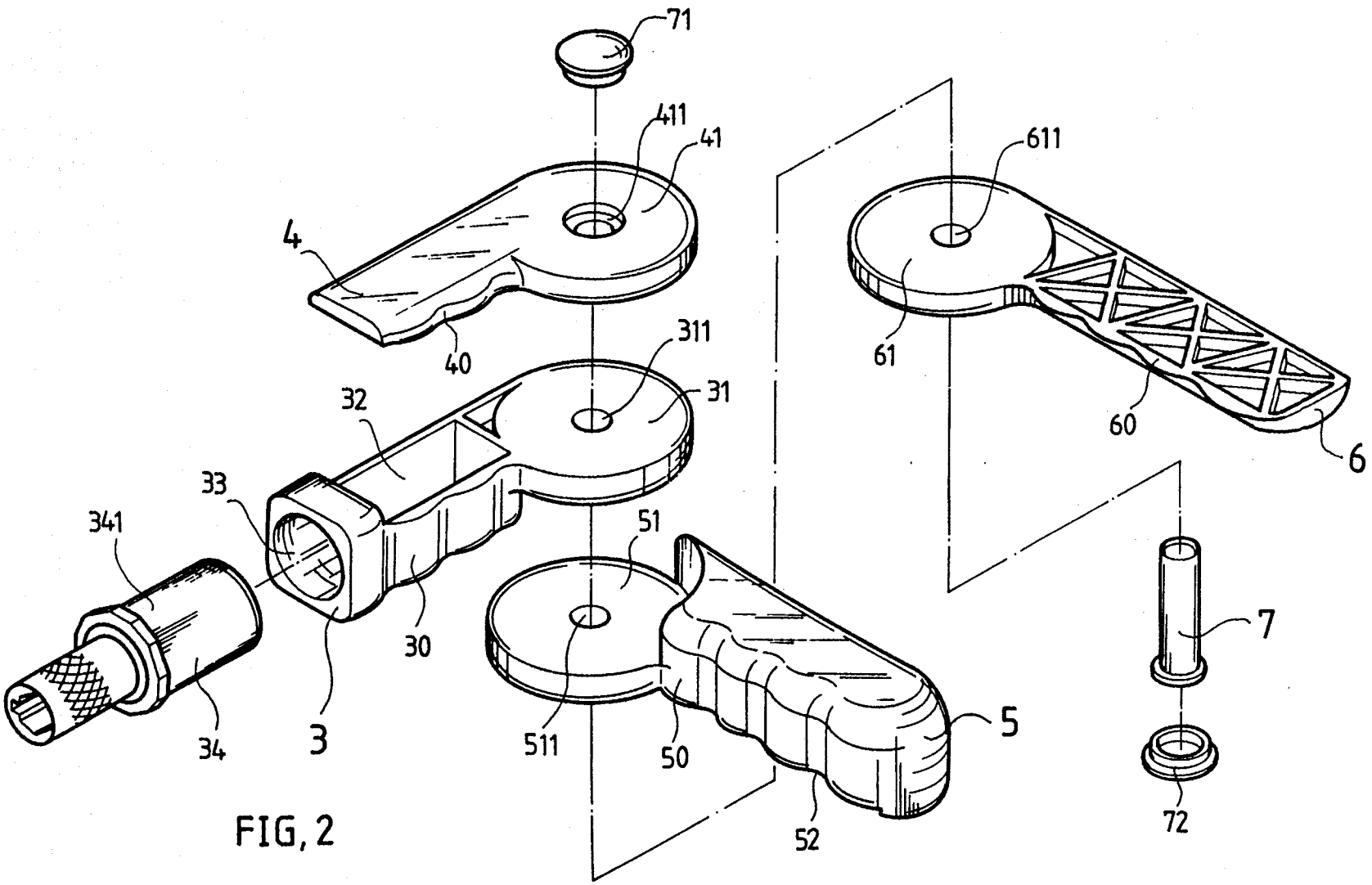
FIG. 2 is an exploded perspective of an embodiment of the present invention.

Please refer to FIGS. 2 and 3. The present invention mainly comprises a fixed handle 3, a first removable cover 4, a movable handle 5, a second removable cover 6, and a riveting pin 7. The fixed handle 3 has a front opening 33 for a tool bit receiving head 34 to fitly connect thereto. The tool bit receiving head 34 has a control switch 341 for controling the positive turning, reverse turning, and fixation of the tool bit receiving head 34. To contain rod-shaped tool bits 9 (not shown) inside the fixed handle 3, the fixed handle 3 is formed with a first compartment 32 therein. The fixed handle 3 further has an overlapping portion 31 opposite to the front opening 33. The overlapping portion 31 is formed with a central through hole 311. And, to facilitate the grip of the fixed handle 3, a grip portion 30 with wave-like profile suitable for fingers to grip is formed at an inner side of the fixed handle 3. The first removable cover 4 is used to open or close the first compartment 32 and also has a wave-profiled grip portion 40 matching with the grip portion 30 of the fixed handle 3. The first removable cover 4 also has an overlapping portion 41 and a centered through hole 411 respectively corresponding to the overlapping portion 31 and the through hole 311 both in their shape and size. The movable handle 5 is formed with a second compartment 52 therein. The second compartment 52 has a plurality pairs of clamping members 521 formed inside it (not shown in FIG. 2) for clamping socket tool bits 8 of different dimensions. The movable handle 5 has an overlapping portion 51 and a centered through hole 511 on the overlapping portion 51 to correspond to the overlapping portion 31 and through hole 311, respectively. To facilitate the grip of the movable handle 5, a wave-profiled grip portion 50 suitable for gripping by fingers is formed at inner side of the movable handle 5 to match with the grip portion of the fixed handle 3. The second removable cover 6 is used to open or close the second compartment 52 and also has a wave-profiled grip portion 60 matching with the grip portion 50 of the movable handle 5. The second removable cover 6 also has an overlapping portion 61 and a centered through hole 611 respectively corresponding to the overlapping portion 51 and the through hole 511 of the movable handle 5. The riveting pin 7 is used to pivotally connect the sequentially overlapped first removable cover 4, the fixed handle 3, the movable handle 5, and the second removable cover 6 by extending through the centered through holes 411, 311, 511 and 611 on the overlapping portions 41, 31, 51, and 61, respectively. A top cap 71 and a bottom cap 72 are respectively plugged in the through holes 411, 611 to stop two ends of the riveting pin 7 separately projecting out of the first removable cover 4 and the second removable cover 6 from slipping out of the overlapped through holes 411, 311, 511, 611, so as to join the fixed handle 3, the movable handle 5, the first and the second removable covers 4, 6 together. The overlapping portions 41, 31, 51, and 61 are so designed that when they are sequentially overlapped and pivotally connected by the riveting pin 7 from top to bottom, they can be smoothly and pivotally turned about the riveting pin 7 relative to one another within a properly predefined range and more particularly, the overlapped fixed handle 3 and first removable cover 4 and the overlapped movable handle 5 and second removable cover 6 can be turned toward each other from an extended state (containing an angle about 90 degrees between two handles) as shown in FIG. 3 to an folded state (with two handles parallel to each other side by side) as shown in FIG. 4.

Please refer to FIG. 5 in which the first removable cover 4 and the second removable cover 6 are pivotally turned about the riveting pin 7 to open the first compartment 32 and the second compartment 52, respectively. The rod-shaped tool bits 9 in the first compartment 32 and the socket-shaped tool bits 8 in the second compartment 52 can thereby be easily accessed and retrieved for connecting to the receiving head 34 in front of the fixed handle 3 for operation. When the tool bit 9 or 8 is not to be used or shall be changed for other operation, just remove it from the receiving head 34 and replace it back to the first or the second compartment 32 or 52 and then, close the first or the second cover 4 or 6 by turning it about the riveting pin 7 until it completely cover the compartment 32 or 52 for safe storage of the tool bits therein. When the wrench of the present invention is in use, the fixed handle 3 and the movable handle 5 are normal to each other. This perpendicular position of the two handles 3, 5 provides considerable big torque and therefore provides labor-saving operation of the wrench.

Figure 6:
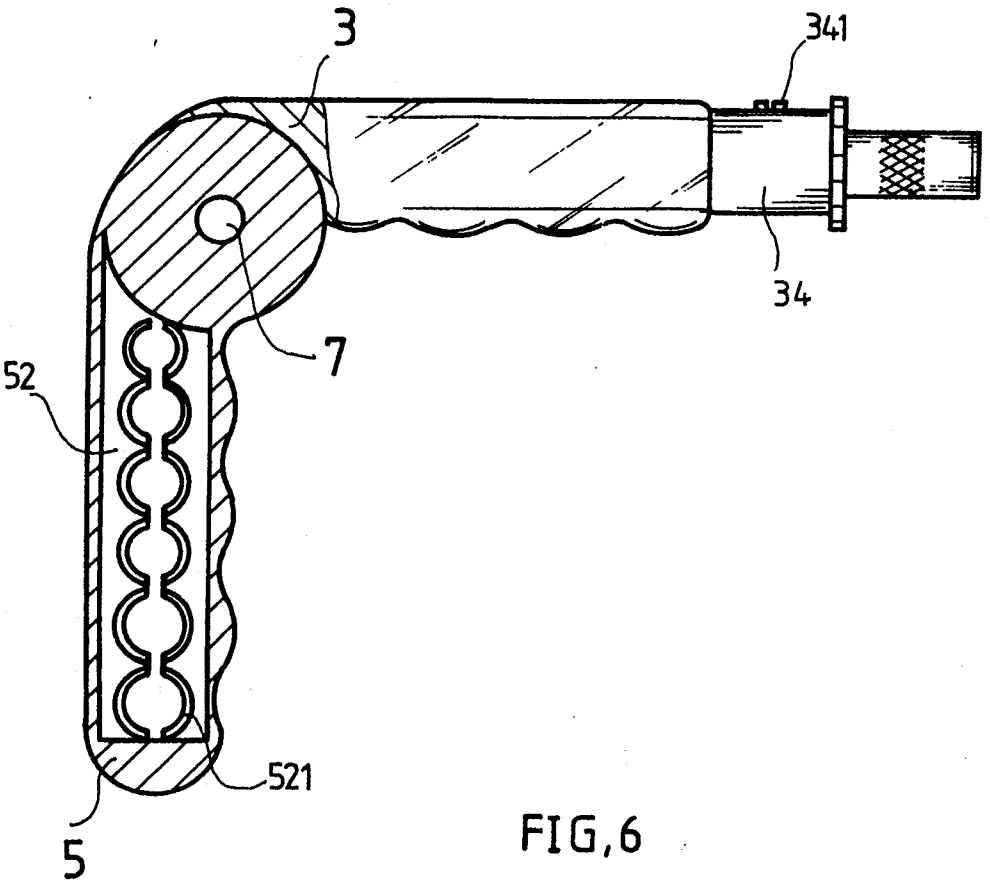
FIG. 6 is a partially sectional side view of the present invention.

As shown in the right hand of FIG. 5 and in FIG. 6, the clamping member pairs 521 provided inside the second compartment 52 of the movable handle 5 may be used to securely clamp various types and sizes of socket tool bits 8 therein while the latter can be conveniently removed out for use.

With the above arrangements, the foldable wrench according to the present invention shall occupy the smallest possible room and be conveniently carried when the fixed and the movable handles, along with the first and the second removable covers 4, 6, are turned toward one another from a perpendicular relation to a parallel relation. Moreover, there is not any exposed sharp tool bit on the wrench when the latter is not in use and thereby provides high safety in carrying. The retrieval or storage of any tool bit in the compartments of the handles can be conveniently done simply by pushing the removable covers away from or toward the corresponding handles. Since the first compartment 32 and the second compartment 52 are respectively designed to accommodate rod-shaped tool bits 9 and socket-shaped tool bits 8, different types of tool bits can be neatly and quickly received in respectively suitable place for future convenient retrieval. The 90-degree extended fixed and movable handles provide time and effort saving operation which is another advantage of the present invention in addition to those mentioned above.

What is claimed is:

1. A foldable wrench capable of containing various tool bits therein, comprising a fixed handle, a first removable cover, a movable handle, a second removable cover, and a riveting pin;

said fixed handle being provided with a front tool bit receiving head for removably receiving a tool bit to be used for a certain operation, a first compartment for containing rod-shaped tool bits therein, a wave-profiled grip portion suitable for gripping by fingers, a first overlapping portion opposite to said tool bit receiving head, and a first through hole centered on said first overlapping portion;

said first removable cover having a configuration corresponding to that of said fixed handle for fitly superimposing on said fixed handle and covering said first compartment, and a second through hole corresponding to said first through hole;

said movable handle being provided with a second compartment formed with a plurality pairs of clamping members for containing socket-shaped tool bits therein, a wave-profiled grip portion corresponding to said grip portion of said fixed handle, a second overlapping portion corresponding to said first overlapping portion of said fixed handle, and a third through hole centered on said second overlapping portion corresponding to said second through hole;

said second removable cover having a configuration corresponding to that of said movable handle for fitly superimposing on said movable handle and covering said second compartment, and a fourth through hole corresponding to said third through hole; and said riveting pin pivotally connecting said first removable cover, said fixed handle, said movable handle, and said second removable cover sequentially by extending through said second, said first, said third, and said fourth through holes and being securely retained in said through holes by means of a top cap and a bottom cap fitly plugged into said first and said fourth through holes, respectively, such that said first removable cover, said fixed handle, said movable handle, and said second removable cover may be turned about said riveting pin relative to one another, that said first and said second removable covers may respectively open or close said first and said second compartments easily to facilitate the retrieval or the storage of tool bits from or in said compartments, and that said fixed handle and said movable handle may be turned toward each other from a perpendicular relation to a parallel relation to occupy the smallest possible room for convenient carrying.

* * * * *